US005988830A

United States Patent [19]

Huang

[11] Patent Number: 5,988,830

[45] Date of Patent: Nov. 23, 1999

[54] STRUCTURE OF A CHRISTMAS LAMP BULBLET AND BULBLET STAND

[76] Inventor: Shun-Feng Huang, 56, Minsheng Street, Fengyuan, Taichung Hsien, 420, Taiwan

[21] Appl. No.: 09/009,591

[22] Filed: Jan. 20, 1998

[51] Int. Cl.[6] ..... H01R 17/00

[52] U.S. Cl. ..... 362/226; 362/249; 439/669.2; 439/619

[58] Field of Search ..... 362/226, 249, 362/319; 439/669.2, 619

[56] References Cited

U.S. PATENT DOCUMENTS

| | | | |
|---|---|---|---|
| 4,592,615 | 6/1986 | Durand | 439/699.2 X |
| 4,593,958 | 6/1986 | Baba | 439/699.2 X |
| 4,795,373 | 1/1989 | Fitzgerald et al. | 439/619 |
| 4,932,901 | 6/1990 | Murakami et al. | 439/619 |
| 5,634,823 | 6/1997 | Furuta et al. | 439/699.2 |
| 5,709,571 | 1/1998 | Briski et al. | 439/699.2 |
| 5,791,940 | 8/1998 | Chen et al. | 439/699.2 X |

*Primary Examiner*—Laura K. Tso

[57] ABSTRACT

An improved structure of a Christmas lamp bulblet and bulblet stand, it mainly comprising a bulblet stand and a bulblet, copper plates and wires go through the bulblet stand. Two semi-circular pieces are disposed inside the bulblet stand, a concave curved trough is disposed on the middle of the semi-circular piece, a convex dot on one side of the semi-circular piece and an insertion trough on the other side. The two semi-circular pieces are in opposite positions. The bulblet has a flat part on the lower end, a positioning pole, a convex dot and stuck-out filaments are disposed of each side of the flat part. Insert the flat part of the bulblet into the bulblet stand, so that the positioning poles are locked with the concave curved troughs, the convex dots with the concave dots, while the copper plates of the wires are positioned inside the insertion troughs, thus the copper plates are in contact with the filaments of the bulblet. Accordingly, the bulblet is conveniently and firmly assembled inside the bulblet stand without the conventional bulblet socket.

1 Claim, 5 Drawing Sheets

STRUCTURE OF A CHRISTMAS LAMP BULBLET AND BULBLET STAND

BACKGROUND OF THE INVENTION

Referring to FIG. 1, a conventional Christmas lamp 10 mainly comprising a bulblet stand 11, a bulblet socket 12 and a bulblet 13. The bulblet stand 11 is connected to wires 14 and copper plates 15, the bulblet 13 is inserted into the bulblet socket 12, filaments 131 extended from the bottom of the bulblet 13 go through holes 121 of the bulblet socket 12 and expose outside. When the bulblet socket 12 together with the bulblet 13 are inserted into the bulblet stand 11, the filaments 131 of the bulblet 13 are in contact with the copper plates 15 of the wires 14 to conduct electric current as referring to FIG. 2. The above-mentioned conventional structure of a Christmas lamp has shortcomings as follow:

1. the bulblet socket 12 has to be made separately, the bulblet 13 has to be inserted into the bulblet socket 12 which also has to be inserted into the bulblet stand 11, the assembly is obviously too complicated and inconvenient.
2. There are chances that the bulblet socket 12 is not inserted into the bulblet stand 11 properly and causes the filaments 131 of the bulblet 13 departed from the copper plates 15 of the wires 14 and thus causes failure of conduction of electric current.
3. need to replace a new bulblet 13 if the bulblet is broken, since the bulblet socket 12 is firmly inserted into the bulblet stand 11, makes it inconvenient to separate the bulblet socket 12 from the bulblet stand 11 and change a new bulblet 13.

The present invention mainly comprising a bulblet stand and a bulber, the bulblet is inserted into the bulblet stand. Two opposite semi-circular pieces are disposed inside the bulblet stand, the bulblet is formed in one piece with a lighting body, a neck part and a flat part, filaments are exposed from the sides of the flat part. A concave curved trough is disposed on the middle of each semi-circular piece, a convex dot is disposed on one side of each semi-circular piece, and an insertion trough is disposed on the other side of each semi-circular piece for insertion of the copper plates of the wires. A convex positioning pole is disposed on the middle of the flat part on both sides, a concave dot is located on both sides of one end of the flat part. Accordingly, the flat part of the bulblet is inserted between the two semi-circular pieces of the bulblet stand with the convex positioning poles locked to the concave curved troughs, while the concave dots correspond to the convex dots. Thus the present invention allows a firm and convenient assembly structure for the bulblet and the bulblet stand without the bulblet socket.

SUMMARY OF THE INVENTION

The objective of the present invention is to provide an improved structure of a Christmas lamp to allow more convenient and firmer assembly of the bulblet and the bulblet stand.

DETAILED DESCRIPTION OF THE INVENTION

Figure 1:
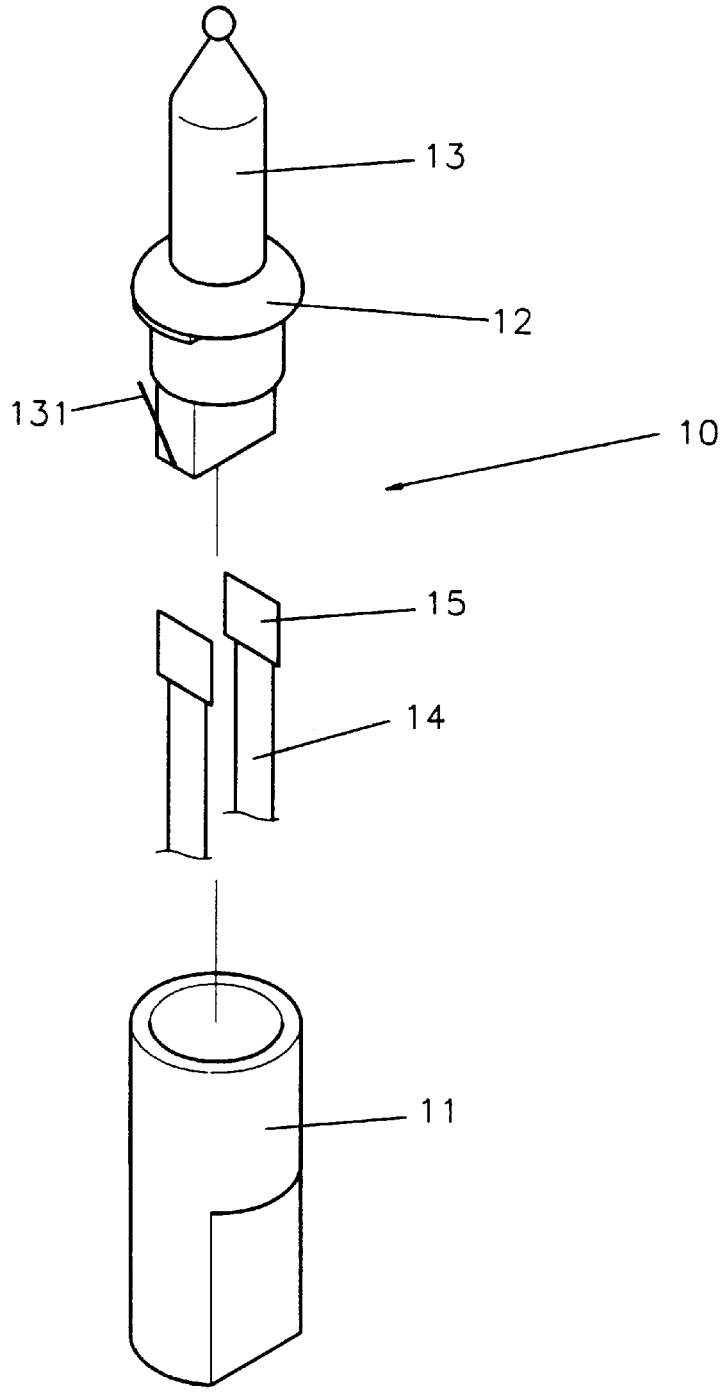
FIG. 1 Prior Art
FIG. 1 is an exploded view of a conventional Christmas lamp.
Figure 2:
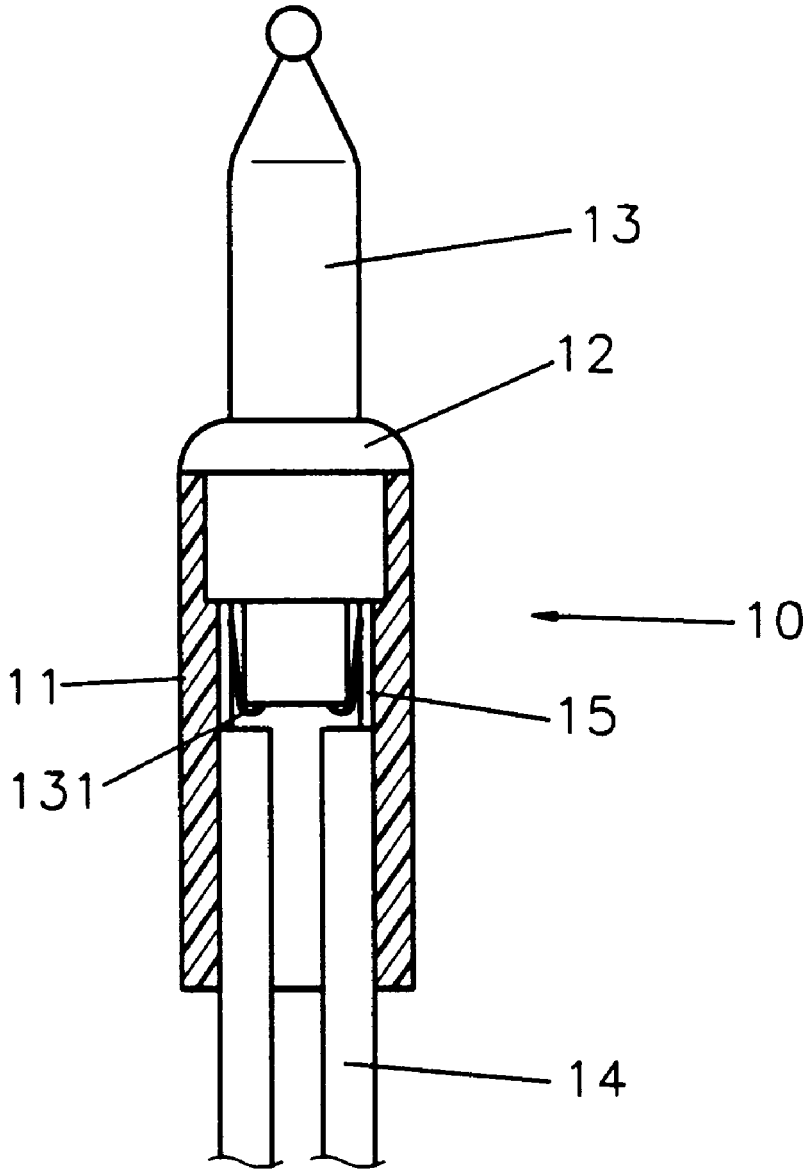
FIG.2 Prior Art
FIG. 2 is a sectional view of a conventional Christmas lamp.
Figure 3:
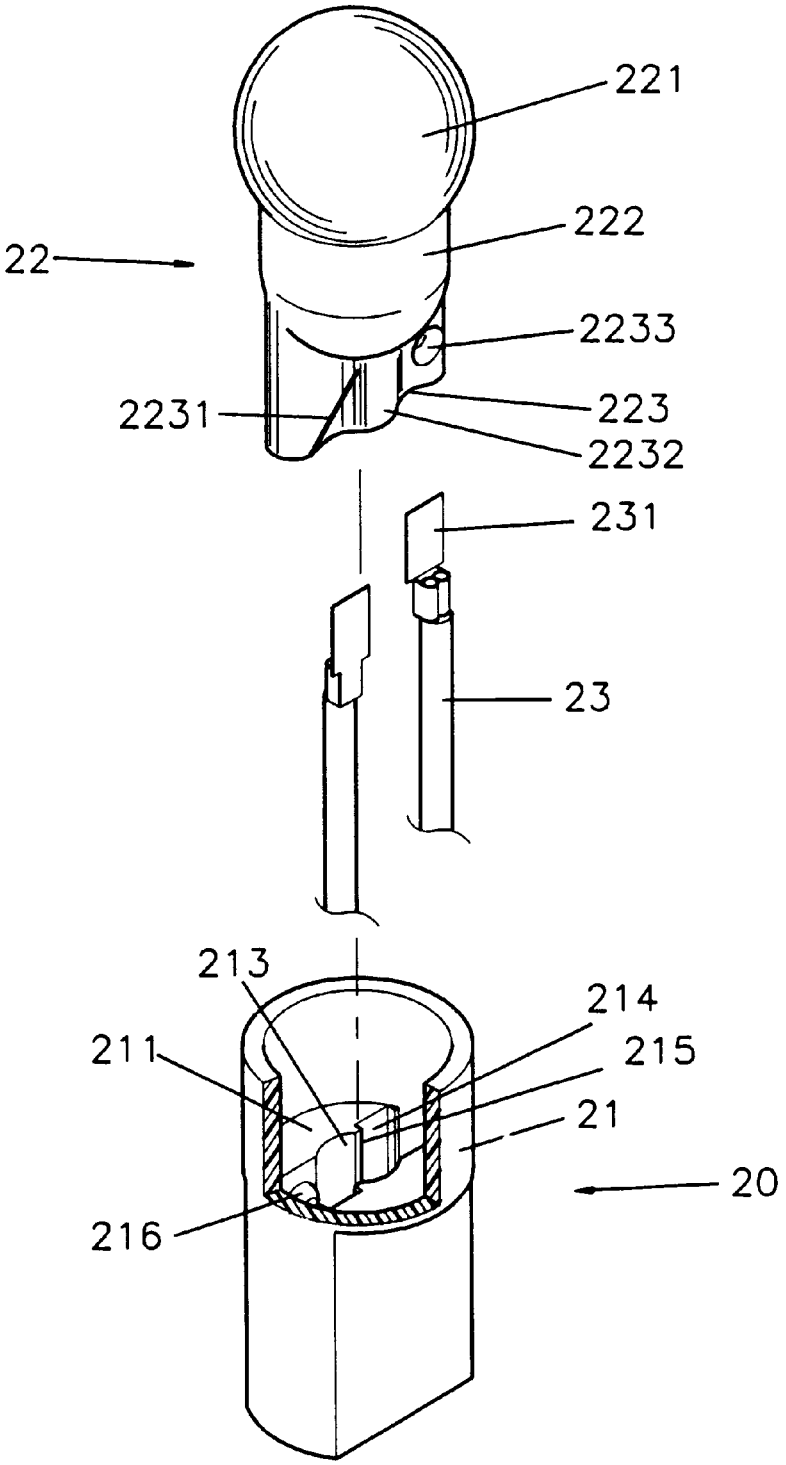
FIG. 3 is an exploded view of the present invention.
Figure 4:
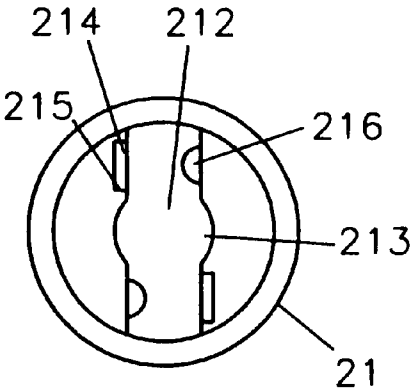
FIG. 4 is a top view of a bulblet of the present invention.
Figure 5:
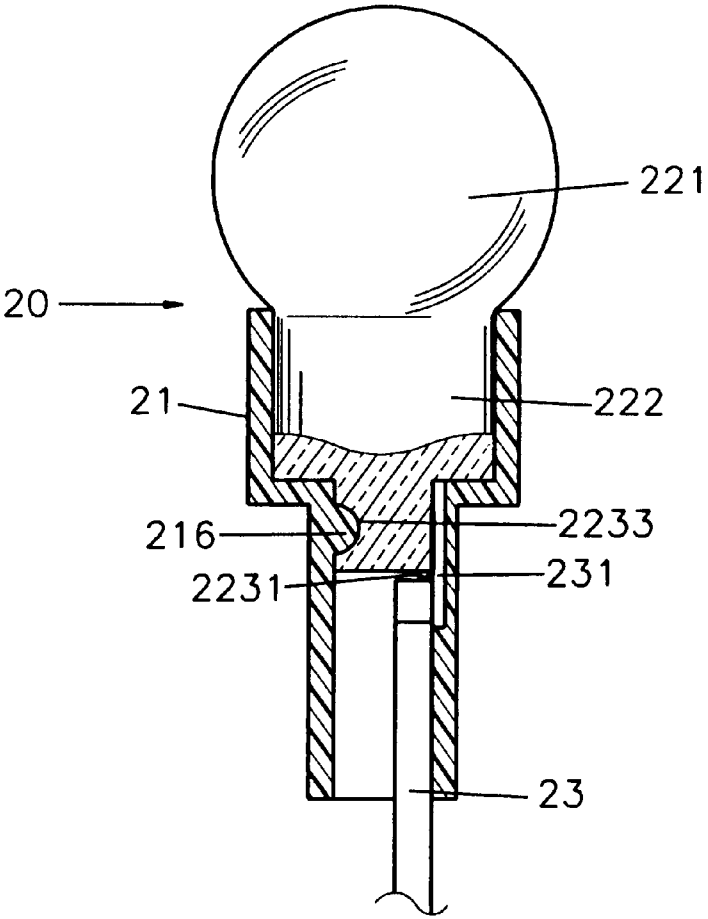
FIG. 5 is sectional assembly view of the present invention.
Figure 6:
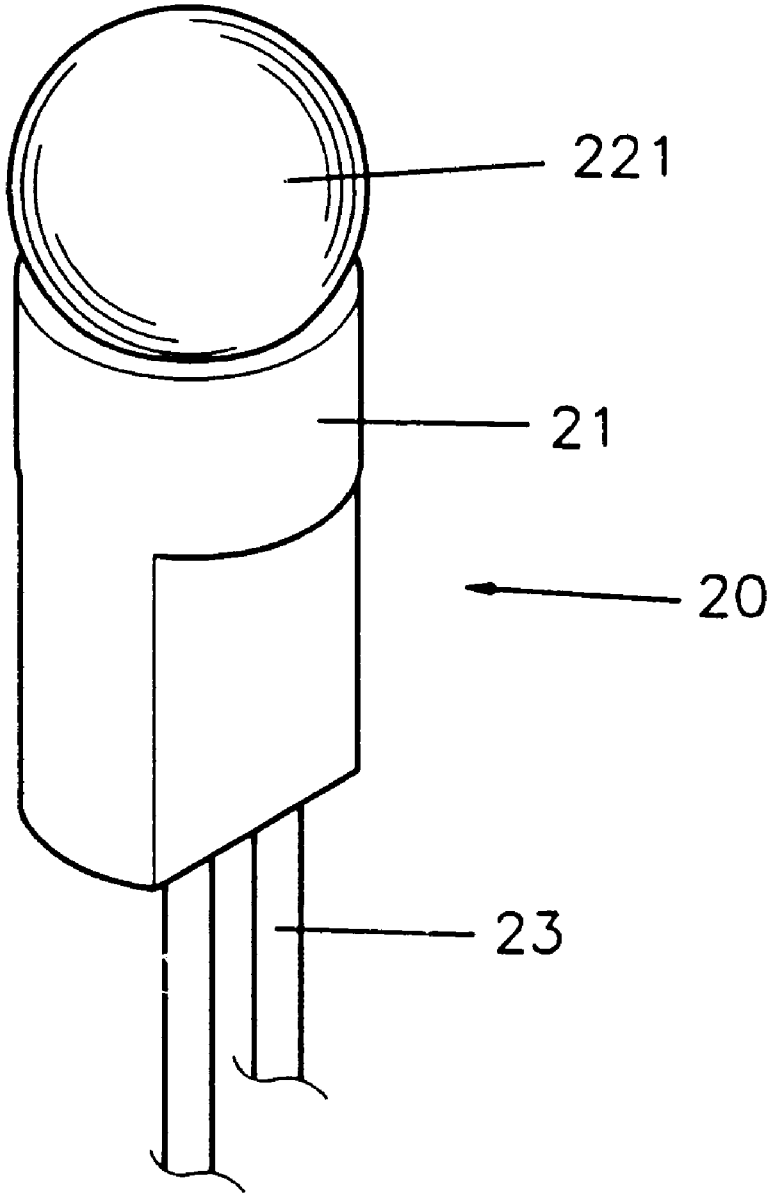
FIG. 6 is a perspective view of another preferred embodiment of a bulblet of the present invention.

Referring to FIGS. 3, 4 & 5, a christmas lamp 20 mainly comprising a bulblet stand 21 and a bulblet 22 without the need of a bulblet socket. Two opposite semi-circular pieces 211 are disposed on the inner surface of the bulblet stand 21, a room 212 is formed between the two semi-circular pieces 211, a concave curved trough 213 is disposed between the semi-circular pieces 211, a bottom stopping piece 215 is disposed under the insertion trough 214, a convex dot 216 is located on the other side of each semi-circular piece 211. The other semi-circular piece has the same structure as mentioned. The bulblet 22 has a lighting body 221, a neck part 222 and a flat part 223 formed in one piece. Filaments 2231 are extended from the bottom of the flat part 223 of the bulblet 22, positioning poles 2232 are disposed on the middle of both sides of the flat part 223, concave dots 2233 are disposed on both sides of one end of the flat part 223. Accordingly, copper plates 231 of wires 23 are inserted into the concave curved troughs 213 of the semi-circular pieces 211 of the bulblet stand 21 and are stopped by the bottom stopping piece 215. Then insert the flat part 223 of the bulblet 22 into the room 212 of the bulblet stand 21, so that the positioning poles 2232 of the flat part 223 are inserted into the concave curved troughs 213, the concave dots 2233 are locked with the convex dots 216, and the filaments 2231 of the bulblet 22 are in contact with the copper plates 231 of the wires 23 to conduct electric current and lighten the bulblet 22. It allows a more convenient assembly for the bulblet 22 and the bulblet stand 21, if the bulblet 22 is burnt, it is very easy to replace it with a new one. The lighting body 221 of the bulblet 22 can be made in elongated shape as referring to FIG. 6 or in round shape.

I claim:

1. An improved structure of a Christmas lamp bulblet and bulblet stand, said bulblet is inserted into said bulblet stand, two semi-circular pieces in opposite positions are disposed inside said bulblet stand, said bulblet is formed in one piece and comprises a lighting body, a neck part and a flat part, filaments are exposed from two sides of said flat part, on the middle of each said semi-circular piece of said bulblet stand has a concave curved trough, a convex dot is disposed on one side of said semi-circular piece, an insertion trough is disposed on the other side for insertion of a copper plate of a wire, a positioning pole is disposed on the middle of each side of said flat part of said bulblet, a concave dot is disposed on one side of said flat part, said bulblet is inserted between two said semi-circular pieces, said positioning poles are locked with said concave curved troughs, said concave dots are locked with said corresponding convex dots.

* * * * *